United States Patent [19]

Umezawa

[11] 4,420,150

[45] Dec. 13, 1983

[54] APPARATUS AND METHOD FOR SEPARATING A SINGLE SHEET FROM A STACK AND CONVEYING IT

[75] Inventor: Michio Umezawa, Kawasaki, Japan

[73] Assignee: Ricoh Company, Ltd., Japan

[21] Appl. No.: 217,553

[22] Filed: Dec. 17, 1980

[30] Foreign Application Priority Data

Dec. 19, 1979 [JP] Japan ..... 54-166026
Dec. 25, 1979 [JP] Japan ..... 54-168746

[51] Int. Cl.[3] ..... B65H 3/08; B65H 7/18

[52] U.S. Cl. ..... 271/11; 271/106; 271/107; 271/108; 271/263

[58] Field of Search ..... 271/106, 107, 108, 90, 271/96, 11, 12, 13, 14, 15, 263

[56] References Cited

U.S. PATENT DOCUMENTS

| | | | |
|---|---|---|---|
| 819,352 | 5/1906 | Kleim | 271/11 |
| 1,259,622 | 3/1918 | Heenss | 271/107 |
| 1,929,361 | 10/1933 | Liljebladh | 271/106 |
| 2,912,240 | 11/1959 | Frankle et al. | 271/106 X |
| 3,039,767 | 6/1962 | Staines | 271/106 X |
| 3,154,306 | 10/1964 | Elliott et al. | 271/106 |
| 4,248,417 | 2/1981 | Fujimoto | 271/107 X |
| 4,299,380 | 11/1981 | Ogihara et al. | 271/107 X |

FOREIGN PATENT DOCUMENTS

| | | | |
|---|---|---|---|
| 673159 | 3/1939 | Fed. Rep. of Germany | 271/106 |
| 55-93744 | 7/1980 | Japan | 271/11 |

*Primary Examiner*—Bruce H. Stoner, Jr.
*Attorney, Agent, or Firm*—Guy W. Shoup; Gerard F. Dunne

[57] ABSTRACT

A sheet receptacle is provided which is capable of carrying a multiplicity of sheets to be separated and conveyed, in theform of a stack. A suction device which shaped like an inverted cup is located above the receptacle and is supported by an associated support member. A piping connects the suction device with an air suction source, which may be operated to apply an air suction. The sucker support member forms part of a mechanism which imparts a rotary motion to the suction device, which is also associated with another mechanism which causes a movement of the suction device in the vertical direction as well as in the fore-and-aft direction. An air intake opening may be formed in the air flow path which connects the suction device with the air suction source, and is provided with a sheet receiver which can be covered by a sheet to be separated and conveyed or a sheet which is equivalent thereto.

19 Claims, 12 Drawing Figures

APPARATUS AND METHOD FOR SEPARATING A SINGLE SHEET FROM A STACK AND CONVEYING IT

BACKGROUND OF THE INVENTION

This invention relates to an apparatus and method for separating a single sheet from a stack and conveying it by utilizing a suction device which applies an air suction to a stack of sheets to separate a single sheet therefrom for conveyance to a given location.

A sheet separating apparatus utilizing a suction device is well known in the art. In the prior art practice, the separation of a single sheet from a stack is reliably achieved by utilizing a suction device with a photosensitive sheet having a photosensitive material applied to its surface or other special paper sheets treated in a manner which lowers their air permeability. However, such apparatus are not suitable for use in combination with many printing apparatus, for example printing apparatus of the ink jet type, which use sheets of a common paper having no such surface treatment, because the air permeability of such sheets can cause more than one superimposed sheet to be attracted to the suction device or no sheet to be attracted to the latter, failing to satisfy the requirement that a single sheet be fed.

On the other hand, with a conventional sheet separation system, it is premised that the negative pressure applied to the sheet from the suction device be maintained constant and invariable. Hence, if the thickness of the paper or the paper quality of the sheets changes, the attraction and separation of a sheet may not be successfully achieved due to the failure of applying a negative pressure of an appropriate magnitude to a particular sheet. If the negative pressure applied is adjustable, the degree of adjustment which can be achieved is on the order of that allowed by manual operation of a valve, which is insufficient to satisfy the requirements for a sheet separation apparatus which may be used in a printing machine or a copying machine where sheets having different thickness or paper quality have to be separated and conveyed, leaving a problem to be overcome.

The problem can be appreciated by considering the situation when a relatively low negative pressure is established. In this instance, a failure to feed a sheet having a high air permeability is likely to occur. Conversely, when a relatively high negative pressure is established, more than one sheet may be fed in superimposed relationship. If a manual adjustment of a valve is relied on to adjust the amount of negative pressure, it is necessary to determine a magnitude of the negative pressure which is suitable for particular sheets used through previous experiments. In addition, the adjustment is a time consuming and troublesome operation inasmuch as the valve must be adjusted each time the thickness or quality of the paper changes.

SUMMARY OF THE INVENTION

It is an object of the invention to provide an apparatus and method for separating a single sheet from a stack which is capable of reliably separating an uppermost one of sheets disposed in a stack on a sheet receptacle even though the air permeability and the thickness of the sheet may vary, and which is capable of conveying such sheets, one by one, to a given location in a reliable manner.

It is another object of the invention to provide an apparatus and method for separating and conveying a single sheet from a stack which utilizes a suction device that is subject to a rotary or tilting motion about a fulcrum which can be chosen close to the lower, rear end of the suction device.

It is a further object of the invention to provide an apparatus and method for separating and conveying a single sheet from a stack which is capable of changing the angle of inclination of a suction device in accordance with the magnitude of the air permeability or paper thickness or rigidity of sheets to be separated.

It is still another object of the invention to provide an apparatus and method for separating and conveying a single sheet from a stack which is capable of changing the magnitude of a negative pressure applied by suction device in accordance with the magnitude of the air permeability or paper rigidity.

In accordance with the invention, a reliable separation of a single sheet is assured if the magnitude of the air permeability or paper rigidity varies from sheet to sheet. It is a simple matter to establish a suitable angle of inclination of a suction device which is used to separate a single sheet from a stack, in accordance with the change of the variety of sheets to be separated. Alternatively, the magnitude of a negative pressure applied by the suction device can be easily and rapidly adjusted in accordance with the change of the variety of sheets to be separated.

DESCRIPTION OF EMBODIMENT

The fundamental process of sheet separation proposed by the present inventor is suitable for use with an apparatus for separating a single sheet from a stack, and, comprises lowering a suction device into contact with the upper surface of an uppermost one of sheets disposed in a stack and applying a suction to the suction device to attract the sheet. Where the sheets have a degree of air permeability, not only the uppermost one hereinafter referred to as a first sheet, but also a second, a third and other sheets may also be attracted, and the suction device is then tilting to fold the one or more of the sheets held to the sucker device about a fulcrum which is located adjacent the rear end of the sucker device, thus restoring those attracted sheets other than the uppermost one to their planar configuration by utilizing the rigidity of the paper, thus separating only the one sheet in the stack which is in direct contact with the sucker device.

The described process is illustrated in FIGS. 1 to 5, to which reference is made.

(1) Sucker device standby step (FIG. 1) A sucker device 1 is formed of a flexible material and is configured like a cup in inverted position. The sucker device 1 is located above the leading end 2 of sheets A disposed in a stack on a sheet receptacle 4, at this stage of the process. While not shown, the sucker device 1 is supported by a support member.

Figure 1:
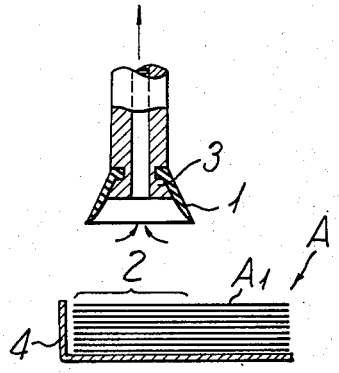
FIGS. 1 to 5 are schematic cross sections of a suction device and a stack of sheets, illustrating the sequential steps of separating a sheet from the stack while imparting a rotary motion to the suction device.
Figure 2:
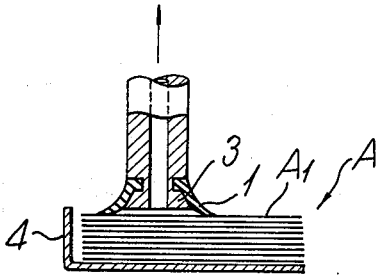

(2) Step of attracting a sheet by lowering the sucker device (FIG. 2).

The sucker device 1 is lowered vertically downward while withdrawing air therein, and comes to a stop at a level which is flush with the upper surface of an uppermost one $A_1$ of the sheets in the stack which remain stationary. Since the air is being withdrawn through the sucker device 1, strictly speaking, the sheet $A_1$ begins to be attracted toward and held attracted by the sucker device 1 immediately before the sucker device reaches the upper surface of the sheet $A_1$ while the latter is stationary.

If the sucker device 1 is then raised directly upward, not only the sheet $A_1$, but a second and/or a third sheet may also be held attracted to the sheet inasmuch as the sheets being here considered are permeable to air. This necessitates the following steps.

Figure 3:
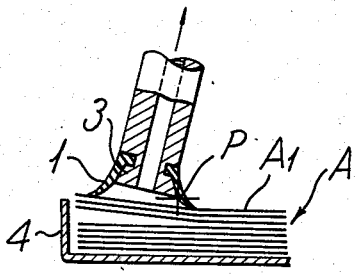

(3) First step of angularly moving or tilting the suction device (FIG. 3).

The suction device 1 is tilted with respect to the plane of the sheets disposed in the stack. By way of example, the suction device 1 may be slightly moved angularly and clockwise about a point P on a metallic tube 3 which supports the suction device 1. One end of the suction device 1 which is located close to the point P will then experience little vertical movement while the other end, or the front end of the suction device 1, will be raised. In this manner, the suction device 1 is tilted substantially around said one end thereof. No significant problem is caused by a slight vertical movement of said one end if a flexible suction device is used. At this stage of the process, a second and a third sheet as well as the uppermost sheet $A_1$ will be folded about the rear end of the suction device 1, serving as the fulcrum, and are raised by being held attracted to the suction device.

Figure 4:
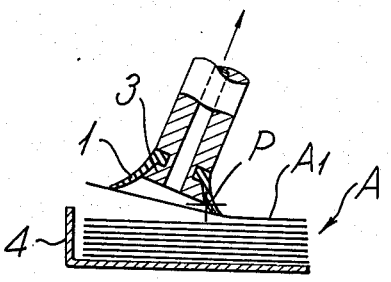

(4) Second step of angularly moving the suction device (FIG. 4).

As the suction device 1 is further tilted, the air suction which is applied to the plurality of sheets during the preceding step will be strongly acting on only the sheet $A_1$ while the remaining sheets attracted have a restoring force attributable to the rigidity of the paper which is greater than the force of attraction applied by the air suction, allowing them to return to their planar form while leaving only the top shet $A_1$ held attracted to the suction device 1. As a result, the single sheet $A_1$ is left attracted to the suction device 1. The number of sheets in the stack to which the suction is effectively applied depends on the magnitude of the negative pressure or the degree of vacuum and the air permeability of the sheets. It will be seen that the suction will be applied to the first sheet directly, but through the first sheet to the second sheet and through the first and second sheets to the third sheet, and thus decreases gradually. Consequently, as the suction device 1 continues to be tilted, the underlying sheets are sequentially separated, leaving only the single sheet which is directly held attracted to the suction device 1. Since there is a significant difference in the magnitude of suction applied to the first sheet as compared with that applied to the second sheet, a reliable separation of a single sheet is achieved by a suitable choice of the tilting angle of the suction device 1 and the magnitude of the negative pressure applied.

Figure 5:
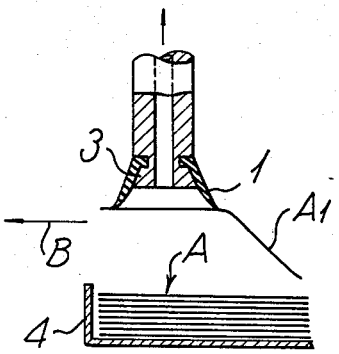

(5) Sheet conveying step (FIG. 5).

The sheet $A_1$ which is held attracted alone to the suction device 1 is moved to a given upper location together with the suction device 1, and the rear portion of the sheet A, then assumes an inclined position. Subsequently, or simultaneously with the vertical movement, the suction device 1 is returned to its vertical position and then carried to the left (which is the condition illustrated in FIG. 5) for cooperation with feed rollers, not shown, to feed the sheet $A_1$ in a sheet conveying direction B. Thereafter, the air suction is interrupted, whereupon the sheet $A_1$ is released from the suction device 1 and the suction device is returned to its original position shown in FIG. 1.

The described process is effective to separate and convey a common type of plain paper while separating a single sheet from the stack and holding it attracted to the suction device. In the above description, it has been mentioned that the suction device 1 is tilted about the point P as the fulcrum, but it should be understood that there is no need that the fulcrum be limited to the point P, but that any portion of the suction device which is in contact with the upper surface of the sheet or any point adjacent the rear end of the suction device may be chosen as the fulcrum for tilting the suction device.

When the described process is applied to an apparatus, inconvenience such as the failure to feed a sheet or a concurrent feeding of more than one sheets may be experienced if the negative pressure of the tilting angle of the suction device is maintained constant when sheets having different thicknesses or magnitudes of air permeability are used in accordance with the user's need.

For example, when a relatively lo negative pressure is used, a thin sheet may be successfully fed, but when thick sheets are used, the rigidity of the paper may cause all of the sheets, which have initially been held attracted to the suction device, to be released therefrom if the same tilting angle is maintained. Conversely, if a relatively high negative pressure is used, a thick sheet may be successfully fed while the reduced magnitude of the rigidity of such thin sheets may result in more than one sheet being concurrently fed as a result of a failure to separate a single sheet. To avoid these difficulties, it is necessary that the negative pressure or the tilting angle of the suction device be altered in accordance with the thickness or the magnitude of air permeability of sheets. Examples of apparatus for separating and conveying a sheet will now be described wherein the negative pressure and the tilting angle of the suction device are separately controlled in accordance with the thickness and the magnitude of air permeability of sheets. It should be understood however that such arrangements may be used in combination.

Considering initially a sheet separating/conveying apparatus in which the tilting angle of the suction device is altered in accordance with the type of sheets encounted. Such sheets may differ by their magnitude of air permeability or rigidity, and it is to be noted at the outset that the negative pressure applied to the suction device of this initial apparatus is maintained constant while the tilting angle of the suction device is increased to assure a positive separation of a single sheet when thin sheets are used while the tilting angle of the suction device is reduced to assure a positive separation of a single sheet when using thicker sheets.

Figure 6:
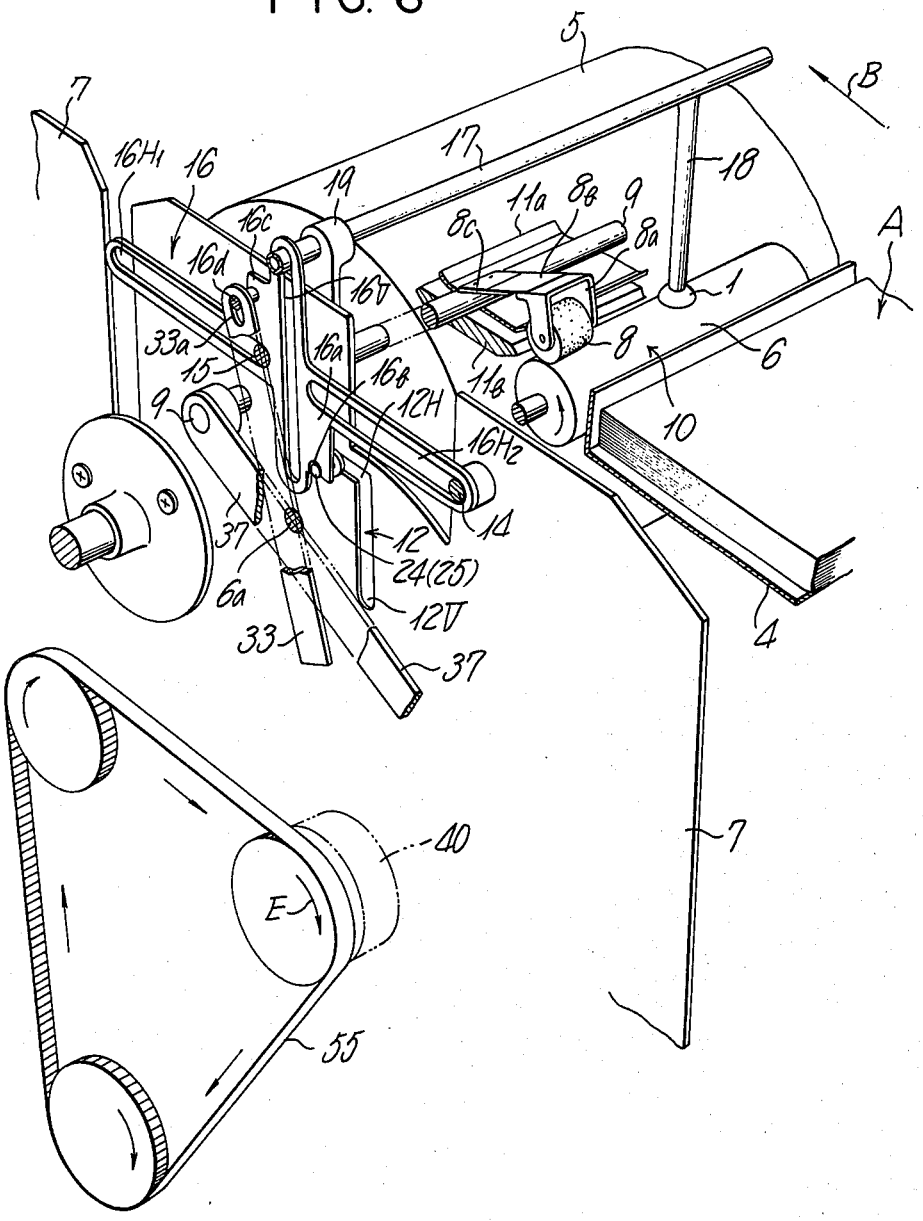
FIG. 6 is a perspective view of the essential parts of a sheet separating/conveying apparatus according to the invention.

Referring to FIG. 6, there is shown a rotary drum 5, around which a single sheet is to be disposed for purposes of printing or copying. The sheet is separated and conveyed from a stack of sheets A disposed on a sheet receptacle 4. Accordingly, the sheet is conveyed along a path extending from the receptacle 4 to the drum 5. The sheet conveying direction B refers to a direction from the receptacle 4 toward the drum 5.

A metallic registering roller 6 is disposed immediately in front of the leading edge of the sheet receptacle 4, and has a shaft 6*a* which extends in a direction perpendicular to the sheet conveying direction B, with its opposite ends being journalled in side plates 7. It is to be understood that for brevity of illustration, only one side plate 7 is shown. The registering roller 6 is adapted to be driven for rotation by means not shown. Also, a clutch, not shown, controls the starting and stopping of the rotation of the roller 6. As shown in FIG. 6, the rotation of the roller 6 occurs counterclockwise.

An idler roller 8 formed of rubber material is located above and adjacent the periphery of the registering roller 6 and is movable toward or away from the latter. The idler 8 is rotatably mounted on a channel-shaped support 8*a*, which is in turn secured to a shaft 9 through a leaf spring 8*b* and another support 8*c*. The purpose of the leaf spring 8*b* is to relieve any shocks which may be experienced when the idler 8 is brought into abutment against the registering roller 6 or to assure a positive abutting relationship therebetween. The shaft 9 extends through the side plates 7 and is journalled therein, and defines part of a first motion transmission system to be described later. The shaft 9 is adapted to rotate through a given angle. As the shaft 9 rotates, the idler 8 moves into abutting relationship with or away from the registering roller 6. It should be noted that a plurality of such idlers 8 and associated supports are spaced apart along the length of the roller 6.

The registering roller 6 and the plurality of idlers 8 are collectively referred to as a registering roller unit 10.

When a sheet approaches, the roller 6 is set in motion in response to the activation of a clutch mentioned previously, but not shown, When the leading end of the sheet moves into the space between the idlers 8 and the roller 6, the idlers 8 are moved into abutment against the roller 6 to hold the sheet therebetween, thus feeding the sheet in the given conveying direction B as the roller 6 rotates.

When delivered from the roller unit 10, the sheet passes between a pair of sheet guide plates 11*a*, 11*b* which are disposed in opposing relationship with each other and supported by the side plates 7, whereby the sheet is guided around the periphery of the drum 5. The leading end of the sheet is held by gripper claws formed on the drum surface, and is wrapped around the drum surface as the drum 5 rotates. It is to be understood that the roller 6 rotates with a peripheral speed which is slightly greater than that of the drum 5 in order to permit the sheet to be engaged with the gripper claws under favorable conditions.

Before the sheet is conveyed from the roller unit 10 to the drum 5, the sheet is conveyed from the receptacle 4 to the roller unit 10. For this purpose, a guide slot 12 is formed in the side plate 7, and includes a horizontal slot portion 12H which extends in the opposite direction from the sheet conveying direction B and is then followed by a vertical slot portion 12V extending vertically downward. A pair of laterally spaced pins 14, 15 are fixedly mounted on the outside of the side plate 7 at a common elevation from the bottom of the side plate 7 which is above the guide slot 12. Each pin engages a horizontal slot portion 16H1, 16H2 of a slider 16, which is crisscross in configuration, and is horrizontally movable to the maximum extent permitted by the slots while being supported by the pins 14, 15.

Figure 8:
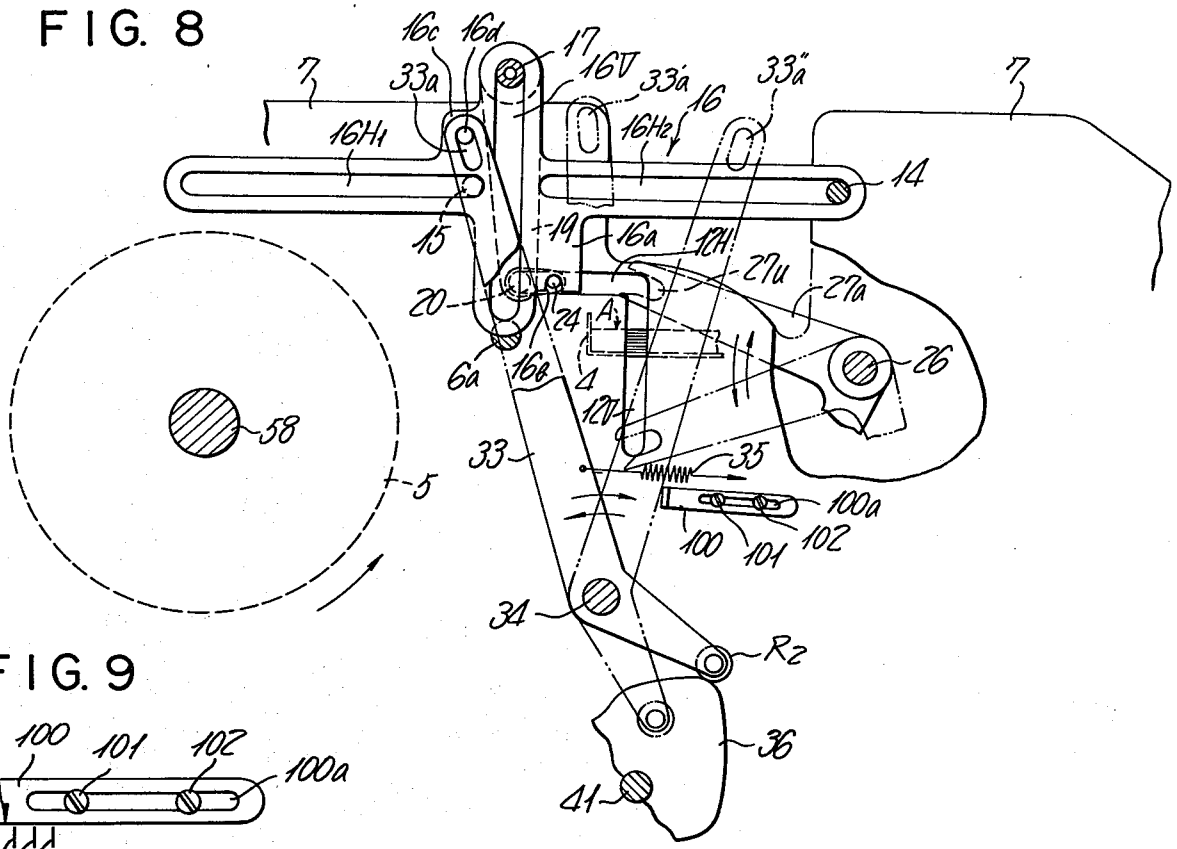
FIG. 8 is a front elevation of the sheet separating/conveying apparatus, essentially illustrating a second motion transmission system and a slider.
Figure 9:
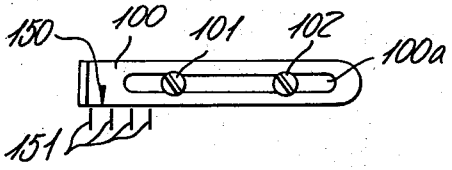
FIG. 9 is a front view of a stop.

However, the stroke through which the slider 16 moves is normally limited by a stop shown at 100 in FIG. 8 and which is retained on the side plate 7 by a pair of screws 101, 102. The stop 100 is movable through a stroke which is determined by an elongate slot 100*a* formed therein, thus controlling the angle through which a second follower arm 33 is angularly movable. This is turn limits the stroke through which the slider 16 moves to thereby control the tilting angle of the suction device 1. A pointer mark 150 and a scale 151 are marked on the stop 100 and the side plate 7, respectively, as shown in FIG. 9, to permit a positional adjustment of the stop 100. In this sense, the screws 101, 102, pointer 150 and scale 151 form part of the stop positioning means in its one form.

Intermediate the horizontal slot portions 16H1, 16H2, the slider 16 is also formed with a vertical slot 16V through which a vacuum pipe 17 extends. The vacuum pipe 17 comprises a double tube extending parallel to the axis of the roller 6, and is formed of a metal or a synthetic resin. At a location where the pipe 17 has immediately passed through the vertical slot 16V, the vacuum pipe 17 is connected with a flexible piping, which is in turn connected to a vacuum pump used as an air suction source, not shown.

It should be understood that another slider which is similar to the slider 16 shown is also slidably mounted on the other side plate which is located opposite to the side plate 7 shown, and the other end of the vacuum pipe 17 extends through a vertical slot formed therein. However, the other end of the vacuum pipe 17 is closed. A plurality of branch pipes 18 depend downwardly from the vacuum pipe 17 between both of the sliders with a suitable spacing therebetween, and the free end of each branch pipe 18 carries a respective suction device 1 which is thus maintained in communication with the vacuum pipe 17. It will be understood that the number of branch pipes 18 and the spacing therebetween are determined in accordance with the width of a sheet to be fed. A guide arm 19 has its one end secured to the vacuum pipe 17 and is located intermediate the lateral end face of the drum 5 and the adjacent side plate 7.

Figure 7:
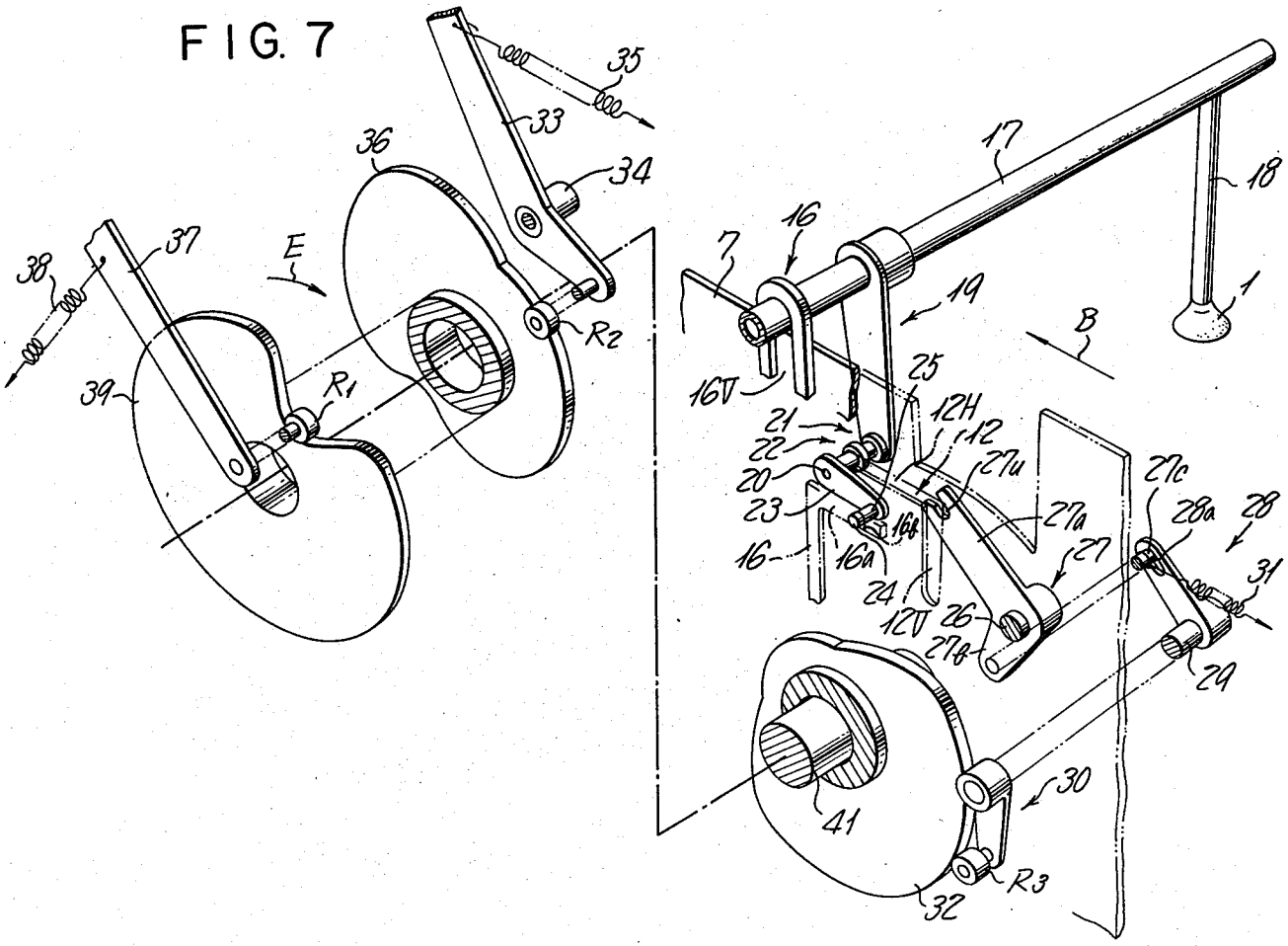
FIG. 7 is an exploded perspective view of a bank of cams and adjacent parts.

Referring to FIG. 7, it will be noted that a pin 20 is fixedly mounted on the free end of the guide arm 19 and extends in a direction toward the adjacent side plate 7. The location of the pin 20 is such that it is concentric with the rear end of the suction device 1 or the rear end of the metal tube 18 which supports the suction device 1, as viewed in the axial direction of the registering roller 6. A U-groove lever engaging portion 21 and a slot engaging portion 22 are formed on the pin 20 in the sequence named as viewed from the end thereof connected with the arm 19. In the position shown in FIGS. 6 and 7, the portion 22 engages the horizontal slot 12H, thus maintaining the vacuum pipe 17 at a given elevation as shown. For the same reason, the suction device 1 is maintained at an elevation which is very close to the peripheral surface of the roller 6. In the position shown in FIGS. 6 and 7, the U-groove lever engaging portion 21 is free from engagement with any member, but is adapted to engage a U-groove 27*u* of a lever 27 during the sheet feeding step which is performed by the sheet feeding apparatus of the invention, which apparatus will be hereafter simply referred to as the present apparatus.

Fixedly mounted on the free end of the pin 20 is an arm 23, which fixedly carries a pin 24 on its free end. A portion 25 of the pin 24 engages the slider 16, and specifically is fitted into a recess 16*b* formed in the slider 16.

Fixedly mounted on the inside of the side plate 7 is a shaft 26, on which the U-groove lever 27 is pivotally mounted. The lever 27 includes a first arm 27*a* and a second arm 27*b*, with the U-groove 27*u* being formed in the free end of the first arm 27*a*. The U-groove 27*u* has the same width as the guide slot 12, even though its opening is slightly enlarged. The U-groove 27*u* is sized to be maintained in overlapping relationship with the vertical slot 12V at all times. The U-groove lever 27 is angularly movable about the shaft 26 through an angle which may be chosen to permit the U-groove 27*u* to move from the upper end to the lower end of the vertical slot 12V. During the vertical movement of the U-groove 27*u*, the size of the overlapping spaces of the U-groove 27*u* and the vertical slot 12V must not be less than the size of the pin portion 22. Under the condition illustrated in FIG. 7, the U-groove 27*u* is located at the upper end of the vertical slot 12V, whereby the U-groove lever engaging portion 21 may ultimately be fitted in the U-groove 27*u* when the pin portion 22 moves along the horizontal slot 12H. The lower corner of the opening of the U-groove 27*u* is shaved off to permit a smooth fitting engagement between the pin portion 22 and the groove.

The slider 16 is integrally formed with a plate 16*a* which is located below the horizontal slot 16H2 and close to the vertical slot 16V. The recess 16*b* is formed in the lower edge of the plate 16*a*. Under the condition shown in FIGS. 6 and 7, the pin portion 25 engages the recess 16*b* in the slider 16 but may be disengaged therefrom during the sheet feeding process with the present apparatus.

A pin 27*c* is fixedly mounted on the free end of the second arm 27*b*, and the free end of pin 27*c* projects toward the inside of the side plate 7 and is fitted into an elongate slot 28*a* formed in the free end of an idle arm 28. The other end of the idle arm 28 is fixedly connected with one end of a shaft 29. The shaft 29 extends through the side plate 7 and is journalled therein and further projects to the opposite side of the side plate 7. A third follower arm 30 has its one end fitted over the other end of the shaft 29 in a manner to permit an angular adjustment thereof with respect to the idle arm 28. It is positioned and secured so that the home position thereof corresponds to the U-groove 27*u* being located at the upper end of the vertical slot 12V. A roller R3 is rotatably mounted on the free end of the third follower arm 30. A third tension spring 31 has its one end anchored to the side plate 7 and has its other end engaged with the pin 27*c*, thus urging the U-groove lever 27 to rotate counterclockwise about the shaft 26 and also acting through the idle arm 28 to urge the third follower arm 30 to rotate clockwise about the shaft 29.

The resulting angular movement of the U-groove lever 27 and the third follower arm 30 is blocked by the abutment of the roller R3 against the peripheral surface of a third disc cam 32. As the third disc cam 32 rotates, the roller R3 oscillates in accordance with the curvature of the cam profile of the third disc cam 32, and the resulting movement is transmitted eventually to the U-groove lever 27, thus causing a vertical movement of the U-groove 27*u* along the vertical slot 12V. The mechanism which causes a vertical movement of the U-groove 27*u* along the vertical slot 12V as the third disc cam 32 rotates is collectively referred to as third motion transmission system. Thus, the third motion transmission system comprises the third follower arm 30 including roller R3, third spring 31, shaft 29, idle arm 28, U-groove lever 27 and their associated parts.

Considering the slider 16 again, it will be noted in FIG. 6 that the slider 16 is integrally formed with a plate 16*c* located above the horizontal slot 16H1. A pin 16*d* is fixedly mounted on the plate 16*c* and is fitted into an elongate slot 33*a* formed in the upper end of a second follower arm 33. Referring to FIG. 7, it will be noted that adjacent its lower end, the second follower arm 33 is pivotally mounted on a shaft 34 which is fixedly mounted on the side plate 7. A roller R2 is rotatably mounted on the lower end of the second follower arm 33. as shown in FIG. 8, a second tension spring 35 has its one end anchored to the side plate 7 and has its other end engaged with the second follower arm 33 intermediate the elongate slot 33*a* and the shaft 34, preferably toward the slot 33*a*. The second spring 35 urges the second follower arm 33 to rotate clockwise about the shaft 34, but the resulting movement of the arm 33 is blocked by the abutment of the roller R2 against the peripheral surface of a second disc cam 36 (FIGS. 7 and 8).

Referring to FIG. 8, the roller R2 oscillates in accordance with the curvature of the cam profile of the second cam disc 36 as the latter rotates. As the roller R2 oscillates, its movement is transmitted to the pin 16*d* through the second follower arm 33 and the slot 33*a*. Since the direction of movement of the slider 16 is constrained by the pins 14, 15, it follows that it moves fore and aft in the sheet feeding direction in accordance with the oscillation of the roller R2. The mechanism which causes a fore-and-aft movement of the slider 16 in the sheet feeding direction as the second disc cam rotates to thereby oscillate the second follower arm 33 is collectively referred to as a second motion transmission system, which comprises the second follower arm 33 including roller R2, shaft 34, second spring 35, pin 16*d* and associated parts.

Referring to FIG. 6, it will be seen that one end of a first follower arm 37 is fixedly mounted on the end of the shaft 9 which projects outside of the side plate 7. A roller R1 is pivotally mounted on the other end of the first follower arm 37 as shown in FIG. 7. A first tension spring 38 has its one end anchored to the side plate 7 and is other end engaged with the first follower arm 37 at a point close to the roller R1. The first spring 38 urges the first follower arm 37 to rotate clockwise about the shaft 9, but the resulting angular movement of the first follower arm 37 is blocked by the abutment of the roller R1 against the peripheral surface of a first disc cam 39.

As the first disc cam 39 rotates, the roller R1 oscillates in accordance with the curvature of the cam profile of the first disc cam 39, and the resulting movement is transmitted through the first follower arm 37 to the shaft 9, thus rotating it. As the shaft 9 rotates, the supports 8*c* fixedly mounted on the shaft 9 also rotate, thus moving the idler rollers 8 which are virtually integral with the supports 8*c* toward or away from the registering roller 6. The mechanism which causes a movement of the idler rollers 8 toward or away from the registering roller 6 in accordance with the rotation of the first disc cam 39 is collectively referred to as a first motion transmission system, which includes the first follower arm 37 including roller R1, first spring 38, shaft 9, support 8*c*, leaf spring 8*b*, another support 8*a* and their associated parts.

The first, the second and the thrid cam 39, 36, 32 which operate the first, the second and third motion transmission system are integrally formed to define a bank of cams 40. The third, the second and the first disc cam 32, 36, 39 are successively disposed in the sequence named as viewed from the side plate 7, the third cam 32 being closest to the side plate 7. The bank of cams 40 is fitted over a cam shaft 41 which is secured to the side plate 7, and is suitably driven for rotation in a direction indicated by an arrow E, by means of a belt 55.

It will be seen that in the described arrangement, the registering roller unit, the guide slots, the guide arms, the bank of cams, the first to the third motion transmission systems constitute together drive means for the suction device which impart a rotary motion, a fore-and-aft movement and a vertical movement to the suction device, as will be further described later.

The operation of the present apparatus will be described below in terms of a sheet separating/conveying process.

(1) Step 1 (home position)

Considering the first motion transmission system, the roller R1 is in abutment against the first guide disc cam 39 while the idler rollers 8 are abutting against the registering roller 6 (FIG. 6). At this time, the rotation of the first follower arm 37 is blocked by the abutment of the roller R1 against the cam profile, so that the idle rollers 8 are maintained in abutment principally by the resilience of the leaf spring 8*b*. The rollers 8 do not rotate.

Considering the second motion transmission system, the roller R2 is in abutment against the second disc cam 36 and the elongate slot 33*a* formed in the second follower arm 33 is situated at the left-most end of the stroke. Consequently, the slider 16 is also located at the left-most end of a stroke, and the pin portion 22 is located within the horizontal slot 12H. The pin 24 engages the recess 16*b*. At this time, the lower end of the suction device is located very close to the peripheral surface of the registering roller 6. No air suction is applied through the suction device 1.

As to the third motion transmission system, the roller R3 is in abutment against the third disc cam 32, and the U-groove 27*u* is located at the right-hand end of the horizontal slot 12H. A number of sheets A are diposed in a stack on the sheet receptacle 4.

The bank of cams 40 begin to rotate under this condition.

(2) Step 2 (idler rollers move away from the registering roller, and the suction device retracts)

Considering the first motion transmission system, as the first disc cam 39 rotates, the first follower arm 37 rotates counterclockwise about the shaft 6*a* against the resilience of the spring 38, whereby the idler rollers 8 move away from the registering roller 6. When the spacing between the registering roller 6 and the idler roller 8 is sufficient to receive a sheet therein, such spacing is subsequently maintained constant until the termination of the step 7 to be described later.

In the third motion transmission system, there is no change in the position of parts from those assumed during the step 1, and hence the U-groove 27*u* is located at the upper end of the vertical slot 12V (and also at the righthand end of the horizontal slot 12H).

In the second motion transmission system, as the second disc cam 36 rotates to change the cam profile which is engaged by the roller R2, the second follower arm 33 rotates clockwise about the shaft 34 against the resilience of the spring 35, whereby the elongate slot 33*a* moves to a position designated at 33'*a* in FIG. 8. Since the slot 33*a* is engaged by the pin 16*d*, the slider 16 retracts horizontally as guided by the pins 14, 15. As the slider 16 moves in this manner, the suction device 1 translates in the same direction and by the same amount since the vacuum pipe 17 is engaged in the vertical slot 16V and the portion 25 of the slider 16 engages the recess 16*b* to permit the vacuum pipe 17 and the portion 25, both of which are integral with the suction device 1, to be moved together with the slider 16. As the slider 16 moves, the U-groove lever engaging portion 21 moves, and the slot engaging portion 22 is led into engagement with the U-groove 27*u* as it is guided by the horizontal slot 12H. The suction device 1 is now located above the leading end of the sheets A. The suction device 1 assumes a position which is similar to that illustrated in FIG. 1.

(3) Step 3 (doward movement of the suction device)

In the second motion transmission system, the parts remain unchanged from the termination of the second step. Consequently, the elongate slot 33*a* is still at the location 33'*a* shown in FIG. 8, and there is no change in the position of the slider 16.

In the third motion transmission system, as the third disc cam 32 rotates, the third follower arm 30 oscillates to move the U-groove lever 27 angularly or counterclockwise about the shaft 26, whereby the U-groove lever engaging portion 21 which has been engaged with the U-groove 27*u* moves down the vertical slot 12V as the slot engaging portion 22 is guided by the vertical slot 12V during the angular movement of the lever 27. Consequently, the suction device 1 which is integral with the engaging portion 22 moves down vertically. During such vertical movement, the pin 24 is automatically disengaged from the recess 16*b*. Such a vertical movement is aided by the gravity of the vacuum pipe 17, the branch pipes 18 and the suction device 1 and also by the resilience of the third spring 31. The position where the suction device 1 ceases to move down any further is determined by the height of the stack of sheets disposed on the sheet receptacle 4. At the end of the step 3, the suction device 1 assumes the position which is shown in FIG. 2.

(4) Step 4 (air suction)

The second motion transmission system remains unchanged as do the first and the third transmission system.

During this step, a vacuum source or an air suction source is connected to the vacuum pipe 17 to apply an air suction.

(5) Step 5 (tilting of the suction device)

In the second motion transmission system, as the second disc cam 36 rotates, the second follower arm 33 rotates clockwise, thus moving the elongate slot 33*a* from the location 33'*a* shown in FIG. 8 to another location 33''*a* shown in FIG. 8. Obviously, the slider 16 retracts horizontally.

As mentioned previously, the groove engaging portion 22 is engaged with the vertical slot 12V and therefore cannot move in the fore-and-aft direction. On the other hand, the slider 16 which engages the vacuum pipe 17 through the vertical slot 16V retracts horizontally, so that the vacuum pipe 17, the branch tube 18 and the suction device 1 are caused to rotate clockwise about the pin 20. As mentioned previously, the pin 20 is disposed in concentric relationship with the rear end of the metal tube 3 which supports the suction device 1, and thus the suction device 1 is tilted about the rear end of the metal tube 3. The tilting movement corresponds to the tilting steps illustrated and described above in connection with FIGS. 3 and 4.

It will be evident that the tilting movement of the suction device 1 is determined by the stroke through which the slider 16 moves, which is in turn determined by the angle through which the second follower arm 33 oscillates as the second disc cam 36 rotates to change its cam profile. Consequently, when the stop 100 is moved further to the left from the position shown in FIG. 8 and secured thereat, the angle through which the second follower arm 33 oscillates is limited to a smaller value, and the stroke through which the slider 16 moves is reduced, thus reducing the tilting angle of the suction device 1. Conversely, when the stop 100 is moved further to the right from the position shown, the tilting angle of the suction device 1 can be increased.

Accordingly, by determining a proper tilting angle for each particular variety of sheets to be fed beforehand by experiments, with reference to the negative pressure applied through the suction device 1 to establish the scale 151 as indicated in FIG. 9, it is possible, even if the negative pressure applied through the suction device 1 remains invariable, to adjust the position of the stop 100 to increase the tilting angle for thinner sheets and to reduce the tilting angle for thicker sheets, thereby assuring a satisfactory sheet separation and conveyance.

(6) Step 6 (restoring the suction device to its original position)

In the second motion transmission system, as the second disc cam 36 rotates, the second follower arm 33 moves counterclockwise about the shaft 34.

When a small tilting angle of the suction device 1 is established, the tilting angle of the second follower arm 33 will be limited by the stop 100 before the roller R2 abuts against the cam profile of the second disc cam 36. This means that the tilting angle of the suction device 1 can be regulated freely and independent from the cam profile. It follows therefore that the cam profile of the second disc cam 36 at a point opposite to the roller R2 during the step 5 must have an elevation (the minimum elevation throughout the cam profile) which is sufficient to permit a maximum tilting angle of the suction device 1. At the end of the stop 6, the elongate slot 33*a* has moved from the location designated 33″*a* to the location 33′*a* shown in FIG. 8. Consequently, the slider 16 moves forward horizontally, turning the vacuum pipe 17, the branch tubes 18 and the suction device 1 counterclockwise about the pin 20, eventually returning them to their non-tilted positions.

In the third motion transmission system, as the third disc cam 32 rotates to cause an oscillation of the third follower arm 30, the U-groove lever 27 turns clockwise about the shaft 26, whereby the pin 20 which is engaged with both the U-groove 27*u* and the vertical slot 12V moves to the home position which is at the upper end of the vertical slot 12V, together with the U-groove 27*u*. In other words, the suction device 1 is returned to the initial elevation which it assumes at the home position.

During this step, the described operations of the second and the third motion transmission system occur concurrently in time, so that as far as the suction device 1 is concerned, it moves upwards while reducing its tilting angle. The pin 24 becomes engaged with the recess 16*b*. Obviously, at the end of this step, only the sheet $A_1$ is separated from the rest of the stack and held attracted to the suction device 1, as illustrated in FIG. 5.

(7) Step 7 (forward movement of the suction device)

In the second motion transmission system, as the second disc cam 36 rotates, the elongate slot 33*a* moves from the location 33′*a* shown in FIG. 8 toward the home position and the slider 16 moves forward or to the left horizontally, so that the suction device 1 moves toward the home position while holding the sheet $A_1$ attracted thereto until eventually the leading end of the sheet $A_1$ reaches a location over the registering roller 6.

In the first motion transmission system, as the first disc cam 39 rotates, the first follower arm 37 oscillates, causing the idler rollers 8 to be eventually led into abutment against the registering roller 6.

At the termination of this step, the sheet $A_1$ has its leading end held in the registering roller unit 10 and a portion thereof which is located adjacent the leading end held attracted by the suction device 1.

This completes one cycle of the sheet separating and conveying process with the present apparatus.

In the embodiment described above, it will be noted that the stop 100 must be driven manually. The position of the stop is determined in accordance with the thickness of the sheets used, utilizing data which relate to the relationship between the sheet thickness and the tilting angle of the suction device and which are previously determined by experiments.

In another embodiment of the invention, an approach is adopted in which the adjustment of the position of the stop is automatically performed. At this end, the sheet thickness is automatically determined by means of a gap sensor, and the value obtained is utilized to drive a servo motor, which establishes the tilting angle of the suction device or the position of the stop automatically.

Figure 10:
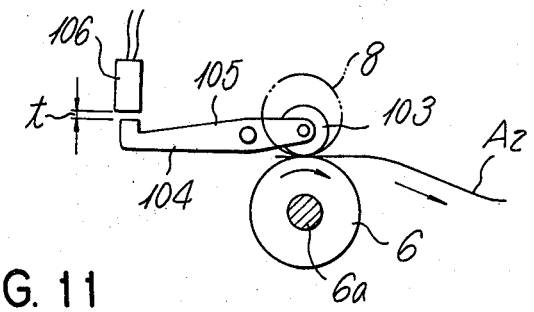
FIG. 10 is a side elevation of a registering roller, illustrating a gap sensor.

Referring to FIG. 10, a roller 103 is disposed in abutment against the upper side of the registering roller 6. The roller 103 is rotatably mounted on one end of a lever 104 which is in turn pivotally mounted on a stationary pin 105. The opposite end of the lever 104 is folded to extend upwardly so as to be located opposite to a gap sensor 106 which is mounted on a stationary member. Any commercially vailable gauge, for example, air micrometer, may be used as the gap sensor 106.

In the embodiment shown, during a sheet conveying operation, a sheet $A_2$ is held between the roller 103 and the registering roller, and the thickness is detected by the gap sensor 106 as the magnitude of a gap t between the other end of the lever 104 and the gap sensor 106 which is determined in accordance with the leverage.

Figure 11:
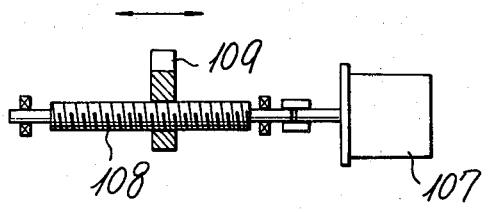
FIG. 11 is a front view of a servo motor and a stop.

The detection signal is transmitted to a servo motor 107 as shown in FIG. 11 to drive it by a corresponding amount. The servo motor 107 includes a rotary shaft which is integral with a threaded shaft 108, the opposite ends of which are rotatably mounted in stationary members. The threaded shaft 108 is threadably engaged with one end of a stop 109, which is substituted for the stop 100 mentioned previously and located so as to serve the same purpose as the latter. It is to be understood that the stop 109 is constrained against rotation when the threaded shaft 108 turns, but is free to move axially of the threaded shaft 108. In this manner, the position of the stop 109 can be controlled in accordance with the thickness of a sheet which passes over the registering roller. It will be understood that in this embodiment, the thickness of the very first sheet after a change in the thickness occurred is determined in order to determine the position of the stop, so that the first sheet must be fed in the registering roller by a manual feeding.

In the arrangement described above, the position of the stops 100, 109 limit the angle through which the second follower arm 33 rotates. However, the position of the stop may be utilized to block a movement of the slider 16 or the vacuum pump 17.

It will be understood from the foregoing description that with the sheet separating and conveying apparatus of the invention, a highly reliable separation and conveyance of a single sheet can be achieved under varying sheet thicknesses when the negative pressure supplied through the sucker is maintained constant.

A further embodiment of the invention in which the negative pressure supplied through the suction device may be easily changed to a proper value in accordance with a change in the sheet thickness or the paper variety or the paper rigidity will now be described. In this apparatus, an air intake opening is provided in an air flow path which connects a suction device with a source of air suction. The end of the air intake opening is formed with a sheet receiver capable of allowing the air to flow thereinto through a sheet to be separated and conveyed or an equivalent sheet whenever the opening is covered by such sheet. Stated differently, the air intake opening is provided separately from an air withdrawing inlet formed in the suction device, and the air intake opening is covered by a sheet which is of the same kind as the sheet being separated. The pressure loss across the air intake opening is previously chosen such that the negative pressure applied to the suction device which balances with the amount of air withdrawn through the sheet which covers the air intake opening coincides in value with a value of the negative pressure applied to the suction device which is determined as appropriate to be utilized in attracting and separating sheets. In this manner, the negative pressure applied to the suction device can be automatically established at a desired value when the air intake opening is covered by the same sheet as that to be separated.

Generally, it may be assumed that when considering sheets of an equal quality, the magnitude of the permeability of sheets will be substantially in proportion to the sheet thickness. Also, it is recognized that the rigidity of the sheet is proportional to the thickness. In consideration of these factors, it will be seen that it is advantageous to change the negative pressure supplied through the suction device in accordance with the sheets being separated when the technique illustrated in FIGS. 1 to 5 is employed. This is because for thinner sheets, the reduced magnitude of the rigidity causes a failure of separating a single sheet if the suction device is angularly moved unless the negative pressure is reduced, thus resulting in feeding more than one sheets in overlapping relationship. Conversely, for thicker sheets, a negative pressure of an insufficient magnitude may give rise to the likelihood that entire sheets may be separated from the suction device 1 due to the increased magnitude of the rigidity as the sucker moves angularly. In this respect, the described characteristics of the sheets are suited to the reduction to practice of the present invention. Stated differently, once the in-flow of the air through the air intake opening (the magnitude of the pressure loss) is established, the desired condition which is ideal for the sheet separation is achieved, inasmuch as so long as sheets of the same quality are used, the negative pressure applied through the suction device tends to be reduced for thinner sheets due to the increased magnitude of the air permeability, while the negative pressure applied through the suction device tends to increase for thicker sheets having an increased magnitude of the rigidity due to the reduced magnitude of the air permeability.

Figure 12:
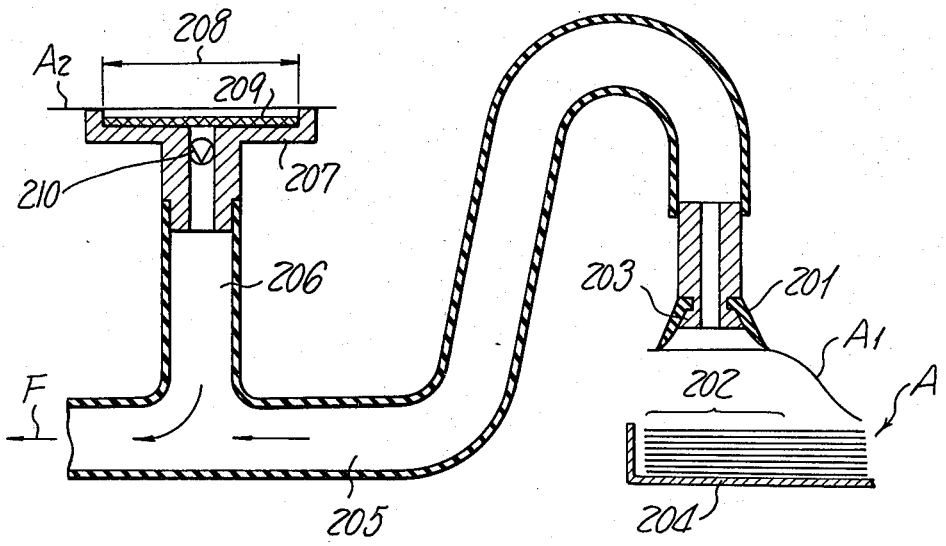
FIG. 12 is a fragmentary cross section of a suction device and a sheet receiver.

Such an embodiment will now be described with reference to FIG. 12. Referring to FIG. 12, a suction device 201 is fitted on a hollow metal member 203, which communicates with one end of an air flow path 205. The flow path 205 is formed by a tubing, and its other end is connected in communication with the source of air suction such as vacuum pump, not shown. A bypass channel 206 is branched from the flow path 205, and a sheet receiver 207 with a flange is mounted on the end of the bypass channel 206 in communication with the atmosphere. The sheet receiver 207 has a concave region 208, on which a sheet is placed to cover the concave region. The concave region 208 defines a virtual air intake opening, and by increasing the area thereof, the sheet can be placed thereon in a stable manner and it is also assured that the magnitude of the air permeability of the sheet be more accurately reflected upon the negative pressure applied through the suction device since the air is withdrawn through the sheet over an increased area thereof.

During a sheet separating operation, the source of air suction, not shown, is operated, whereby the air is withdrawn through both the suction device 201 and the concave region 208 and flows in a direction indicated by an arrow F toward the source of air suction.

When carrying out the present invention, a sheet which is the same as the sheet A disposed in a stack on a sheet receptacle 204 or which has the same magnitude of air permeability and paper rigidity is placed on the sheet receiver 207. Subsequently, the suction device 201 is subjected to the motion described above in connection with FIGS. 1 to 5, whereupon the suction device 201 attracts an uppermost sheet $A_1$ at an area corresponding to the leading end 202 of the sheet. Simultaneously, the sheet $A_2$ on the sheet receiver 207 is held tight against it. An air stream which flows into the bypass path 206 through the sheet A2 causes the pressure within the air flow path 205 to be reduced, thus adjusting the force of attraction by the suction device 201 to be a proper one. Once the pressure loss across the sheet receiver 207 is properly established, the force of attraction by the suction device 201 is maintained at a proper value for varying sheet thickness since a thicker sheet having a reduced magnitude of air permeability tends to increase the negative pressure applied through the suction device while a thinner sheet having an increased magnitude of air permeability tends to reduce the negative pressure applied through the suction device.

The presence of a given relationship between the sheet thickness, the air permeability and the paper rigidity for sheets of an equal quality permits an accommodation for varying sheet thickness without changing the pressure loss across the bypass channel. When the paper quality is changed, the value of the pressure loss across the bypass channel must be changed in order to achieve a proper value of the negative pressure applied through the suction device.

The negative pressure applied through the suction device can be maintained at a proper value by a suitable choice of the area of concave region 208 which in turn controls the amount of air flow into the bypass channel 206, and hence the negative pressure. Accordingly, a number of sheet receivers 207 are formed which have different areas for the concave region 208. When changing the variety of sheets, a suitable one of the sheet receivers which is adequate for use with the particular sheet is used.

Where the magnitude of the negative pressure varies as a result of a replacement of the vacuum pump or a temperature rise thereof, a fine pressure adjustment can be achieved by means of an annular member such as washer which is formed of an air impermeable material and which is disposed above or below the sheet $A_2$ or by means of a valve device 210 to control the size of the opening to the bypass channel 206. The valve device may take any appropriate form and may, for example, be a shutter mechanism such as one corresponding to the type of shutter used to control the size of the aperture of a photographic camera. Alternatively, an air permeable member such as metal meshwork shown at 209 in FIG. 12 may be used for purpose of such adjustment.

It will be appreciated that with this embodiment, a value of the negative pressure applied through the suction device which is appropriate for use with particular sheets being used can be easily and rapidly obtained.

It should be understood that essential parts of the sheet separating and conveying apparatus illustrated in FIG. 12 may be used in combination with the sheet separating and conveying apparatus illustrated in FIGS. 6 to 12. In such instance, the vacuum pipe 17 shown in FIG. 6, for example, may be partly formed with the bypass channel, to the end of which a member such as the sheet receiver 207 shown in FIG. 11 may be connected.

What is claimed is:

1. An apparatus for separating sheets individually from a stack of sheets and conveying the separated sheets individually to a selected location comprising:

at least one suction device;

means associated with each said suction device for connecting it to a source of suction; and drive means associated with each said suction device for moving it adjacent the uppermost sheet in said stack for attracting said uppermost sheet thereto by suction, thereafter tilting each said suction device to thereby separate any underlying sheets attracted thereto and then moving each said suction device towards said location to transport said uppermost sheet thereto, said drive means including adjusting means connected to each said suction device for adjusting the angle of tilt thereof according to characteristics of the sheet in said stack, said adjusting means including means for determining the thickness of a sheet from said stack and means associated with said thickness-determining means for adjusting said angle of tilt automatically as a function of thickness determined for the sheet.

2. An apparatus according to claim 1, including a registration roller held rotatably by a side plate of said apparatus and located at said location; an idler roller movable into engagement with said registration roller; said drive means including a guide slot formed in said side plate, said guide slot having a horizontal portion extending from said roller back towards said stack and leading to a vertical portion extending downwardly along the side of said stack, a guide arm having one end portion connected to each said suction device and the other end portion carrying an engaging portion fitting within said guide slot, means including a lever having a U-shaped opening in its forward end adapted to receive said engaging portion and swingable along the vertical portion of said slot for moving said suction devices vertically, and a slider mounted slidably on said side plate along a horizontal path and engaging said engaging portion; further including a bank of cams including three disc cams, a first motion transmission means connected to a first one of said disc cams for controlling movement of said idler roller towards and away from said registration roller in response to rotation of said first disc cam, a second motion transmission means connected to a second one of said disc cams for moving said slider horizontally in response to rotation of said second disc cam, and a third motion transmission means connected to a third one of said disc cams for angularly moving said lever to move its U-shaped opening vertically within said vertical portion of said guide slot as said third cam rotates.

3. An apparatus according to claim 2, said second motion transmission means serving to tilt each said suction device and including a stop disposed to serve as said adjusting means, and means for positioning said stop.

4. An apparatus according to claim 3, said positioning means including a holding means including a threaded shaft for holding said stop in position and a scale associated with said stop for indicating the degree of tilt of each of said suction device.

5. An apparatus according to claim 3, said positioning means including means for sensing the thickness of a sheet on said stack, a servo motor connected to said stop for moving it in response to control signals to said servo motor and means connected to said sensing means for producing said control signals in in accordance with the thickness of said sheet.

6. An apparatus according to claim 1, said connecting means including a conduit leading to each of said suction devices, said conduit being formed with an opening leading to the ambient and located between each said suction device and the source of suction, and means provided over said opening for receiving another sheet comparable to the sheet to be attracted by each said suction device for covering said opening by said another sheet.

7. An apparatus according to claim 6, further including means associated with said opening for regulating the pressure loss thereacross to enable the suction applied to each said suction device to be varied.

8. An apparatus according to claim 7, said pressure-regulating means including a valve for restricting the size of a conduit leading from said opening.

9. An apparatus according to claim 7, said pressure-regulating means including an air-permeable member mounted removably over said opening.

10. An apparatus for separating sheets individually from a stack of sheets and conveying the separated sheets individually to a selected location, comprising:

at least one suction device;

means including a conduit connected with each said suction device for connecting it to a source of suction;

drive means connected to each said suction device for moving it adjacent the uppermost sheet in said stack for attracting it thereto by suction and thereafter moving each said suction device towards said location; and said conduit being formed with an opening leading to the ambient and located between each said suction device and the source of suction, and means provided over said opening for receiving another sheet comparable to the sheet to be attracted by each said suction device for covering said opening by said another sheet.

11. An apparatus according to claim 10, further including means associated with said opening for regulating the pressure loss thereacross to enable the suction applied to each said suction device to be varied.

12. An apparatus according to claim 11, said pressure-regulating means including a valve for restricting the size of a conduit leading from said opening.

13. An apparatus according to claim 11, said pressure-regulating means including an air-permeable member mounted removably over said opening.

14. An apparatus according to claim 10, said drive means including means for tilting each said suction device after attracting said uppermost sheet thereto.

15. An apparatus according to claim 14, said drive means including adjusting means connected to each said suction device for adjusting the angle of tilt thereof according to characteristics of the sheets in said stack.

16. An apparatus according to claim 15, said tilt-adjusting means including means for determining the thickness of a sheet from said stack and means associated with said thickness-determining means for adjusting said angle of tilt automatically as a function of the thickness determined for the sheet.

17. A method for separating sheets individually from a stack of sheets and conveying the separated sheets individually to a selected location by use of at least one suction device; comprising the steps of:

connecting each said suction device to a source of suction by a conduit;

moving each said suction device adjacent the uppermost sheet in said stack for attracting it thereto by suction and thereafter moving each said suction device towards said location;

said conduit being formed with an opening leading to the ambient and located between each said suction device and the source of suction, and placing another sheet comparable to the sheet to be attracted by each said suction device over said opening for covering said opening by said another sheet.

18. A method according to claim 17, further including the step of regulating the pressure loss across said opening to enable the suction applied to each said suction device to be varied.

19. A method according to claim 17, including the step of tilting each said suction device after attracting said uppermost sheet thereto.

* * * * *